US011713645B2

(12) United States Patent
Slup et al.

(10) Patent No.: US 11,713,645 B2
(45) Date of Patent: Aug. 1, 2023

(54) DOWNHOLE SETTING SYSTEM FOR USE IN A WELLBORE

(71) Applicant: The WellBoss Company, LLC, Houston, TX (US)

(72) Inventors: Gabriel Antoniu Slup, Spring, TX (US); Martin Paul Coronado, Fulshear, TX (US)

(73) Assignee: The WellBoss Company, LLC, Houston, TX (US)

( * ) Notice: Subject to any disclaimer, the term of this patent is extended or adjusted under 35 U.S.C. 154(b) by 71 days.

(21) Appl. No.: 17/072,121

(22) Filed: Oct. 16, 2020

(65) Prior Publication Data

US 2021/0115752 A1 Apr. 22, 2021

Related U.S. Application Data

(60) Provisional application No. 62/916,034, filed on Oct. 16, 2019.

(51) Int. Cl.
*E21B 33/129* (2006.01)
*E21B 23/00* (2006.01)
*E21B 33/12* (2006.01)

(52) U.S. Cl.
CPC ..... *E21B 33/1293* (2013.01); *E21B 23/00* (2013.01); *E21B 33/1208* (2013.01); *E21B 2200/08* (2020.05)

(58) Field of Classification Search
CPC ..... E21B 33/12; E21B 23/06; E21B 23/00
See application file for complete search history.

(56) References Cited

U.S. PATENT DOCUMENTS

| | | | | |
|---|---|---|---|---|
| 2,225,143 | A * | 12/1940 | Baker | E21B 33/128 166/134 |
| 2,230,712 | A | 2/1941 | Bendeler et al. | |
| 2,683,492 | A | 7/1954 | Baker | |
| 2,797,758 | A | 7/1957 | Showalter | |
| 3,163,225 | A | 12/1964 | Perkins | |
| 3,343,607 | A | 9/1967 | Current | |
| 3,422,898 | A | 1/1969 | Conrad | |
| 3,687,196 | A | 8/1972 | Mullins | |
| 3,769,127 | A | 10/1973 | Goldsworthy et al. | |
| 3,776,561 | A | 12/1973 | Haney | |
| 4,359,090 | A | 11/1982 | Luke | |
| 4,388,971 | A | 6/1983 | Peterson | |
| 4,436,150 | A | 3/1984 | Barker | |
| 4,437,516 | A | 3/1984 | Cockrell | |
| 4,440,223 | A | 4/1984 | Akkerman | |
| 4,469,172 | A | 9/1984 | Clark | |

(Continued)

FOREIGN PATENT DOCUMENTS

| | | |
|---|---|---|
| EP | 0136659 | 4/1985 |
| EP | 0504848 | 9/1992 |

(Continued)

*Primary Examiner* — Theodore N Yao
(74) *Attorney, Agent, or Firm* — Kearney, McWilliams & Davis, PLLC; John M. De Boer

(57) ABSTRACT

A downhole tool suitable for use in a wellbore, the tool having a cone mandrel having a dual-cone outer surface. The downhole tool includes a carrier ring disposed around one end of the cone mandrel, and a seal element disposed around the carrier ring. There is a slip disposed around or proximate to an other end of the cone mandrel.

20 Claims, 8 Drawing Sheets

(56) References Cited

U.S. PATENT DOCUMENTS 4,630,690 A 12/1986 Beasley et al.
4,711,300 A 12/1987 Wardlaw et al.
4,784,226 A 11/1988 Wyatt
5,025,858 A 6/1991 Glaser
5,048,606 A 9/1991 Allwin
5,113,940 A 5/1992 Glaser
5,147,857 A 9/1992 Raddatz et al.
5,224,540 A 7/1993 Streich et al.
5,246,069 A 9/1993 Glaser et al.
5,253,714 A 10/1993 Davis et al.
5,333,685 A 8/1994 Gilbert
5,376,200 A 12/1994 Hall
5,449,040 A 9/1995 Milner
5,484,040 A 1/1996 Penisson
5,819,846 A 10/1998 Bolt et al.
5,839,515 A 11/1998 Yuan et al.
5,842,517 A 12/1998 Coone
5,927,403 A 7/1999 Dallas
5,967,352 A 10/1999 Repp
5,984,007 A 11/1999 Yuan
6,167,963 B1 1/2001 McMahan et al.
6,241,018 B1 6/2001 Eriksen
6,353,771 B1 3/2002 Southland
6,354,372 B1 * 3/2002 Carisella ..... E21B 33/1216 166/134
6,425,442 B1 7/2002 Latiolais et al.
6,491,116 B2 12/2002 Berscheidt et al.
6,578,638 B2 6/2003 Guillory
6,708,768 B2 3/2004 Slup et al.
6,712,153 B2 3/2004 Turley et al.
6,899,181 B2 5/2005 Simpson et al.
7,044,230 B2 5/2006 Starr et al.
7,087,109 B2 8/2006 Bredt et al.
7,093,664 B2 8/2006 Todd et al.
7,255,178 B2 8/2007 Slup et al.
7,350,569 B2 4/2008 Collins et al.
7,350,582 B2 4/2008 McKeachnie et al.
7,475,736 B2 1/2009 Lehr et al.
7,484,940 B2 2/2009 O'Neill
7,735,549 B1 6/2010 Nish et al.
7,740,079 B2 6/2010 Clayton et al.
7,753,416 B2 7/2010 Mazzaferro et al.
7,762,323 B2 7/2010 Frazier
7,980,300 B2 7/2011 Roberts et al.
8,002,030 B2 8/2011 Turley et al.
8,016,295 B2 9/2011 Guest et al.
8,079,413 B2 12/2011 Frazier
8,113,276 B2 2/2012 Greenlee et al.
8,127,851 B2 3/2012 Misselbrook
8,167,033 B2 5/2012 White
8,205,671 B1 6/2012 Branton
8,211,248 B2 7/2012 Marya
8,231,947 B2 7/2012 Vaidya et al.
8,267,177 B1 9/2012 Vogel et al.
D673,182 S 12/2012 Frazier
8,336,616 B1 12/2012 McClinton
8,381,809 B2 2/2013 White
8,459,346 B2 6/2013 Frazier
8,469,088 B2 6/2013 Shkurti et al.
8,567,492 B2 * 10/2013 White ..... E21B 33/1216 166/134
8,596,347 B2 12/2013 Valencia et al.
8,839,855 B1 2/2014 McClinton et al.
8,770,276 B1 7/2014 Nish et al.
8,770,280 B2 7/2014 Buytaert et al.
8,839,869 B2 9/2014 Porter et al.
8,887,818 B1 11/2014 Carr et al.
8,893,780 B2 11/2014 Greenlee et al.
9,080,403 B2 * 7/2015 Xu ..... E21B 23/01
9,416,617 B2 8/2016 Wiese et al.
9,708,878 B2 7/2017 Cooke, Jr.
9,714,551 B2 7/2017 Okura et al.
9,745,847 B2 8/2017 Ditzler et al.
9,790,763 B2 10/2017 Fripp et al.
D806,136 S 12/2017 Saulou et al.
9,845,658 B1 12/2017 Nish et al.
9,982,506 B2 5/2018 Walton et al.
10,808,491 B1 * 10/2020 Dirocco ..... E21B 33/128
2003/0188876 A1 10/2003 Vick et al.
2003/0221833 A1 * 12/2003 Gentry ..... E21B 23/01 166/305.1
2003/0226660 A1 12/2003 Winslow et al.
2003/0236173 A1 12/2003 Dobson et al.
2004/0003928 A1 1/2004 Frazier
2004/0045723 A1 3/2004 Slup et al.
2004/0216868 A1 11/2004 Owen, Sr.
2005/0109502 A1 5/2005 Buc Slay et al.
2005/0183864 A1 8/2005 Trinder
2005/0194141 A1 9/2005 Sinclair et al.
2006/0243455 A1 11/2006 Telfer
2007/0003449 A1 1/2007 Hatamian et al.
2007/0039742 A1 2/2007 Costa
2007/0119600 A1 5/2007 Slup et al.
2008/0128133 A1 6/2008 Turley et al.
2008/0196879 A1 8/2008 Broome et al.
2008/0264627 A1 10/2008 Roberts et al.
2008/0277162 A1 11/2008 DiFoggio
2009/0038790 A1 2/2009 Barlow
2009/0090516 A1 4/2009 Delucia et al.
2009/0229424 A1 9/2009 Montgomery
2009/0236091 A1 9/2009 Hammami et al.
2010/0155050 A1 6/2010 Frazier
2010/0263876 A1 10/2010 Frazier
2010/0276159 A1 * 11/2010 Mailand ..... E21B 33/129 166/216
2010/0326660 A1 12/2010 Ballard et al.
2011/0024134 A1 2/2011 Buckner
2011/0048740 A1 3/2011 Ward et al.
2011/0048743 A1 3/2011 Stafford et al.
2011/0088891 A1 4/2011 Stout
2011/0094802 A1 4/2011 Vatne
2011/0186306 A1 8/2011 Marya et al.
2011/0232899 A1 9/2011 Porter
2011/0259610 A1 10/2011 Shkurti et al.
2011/0277989 A1 11/2011 Frazier
2011/0290473 A1 12/2011 Frazier
2012/0061105 A1 3/2012 Neer et al.
2012/0125642 A1 5/2012 Chenault et al.
2012/0181032 A1 7/2012 Naedler et al.
2012/0234538 A1 9/2012 Martin et al.
2012/0279700 A1 11/2012 Frazier
2013/0032357 A1 2/2013 Mazyar et al.
2013/0098600 A1 4/2013 Roberts
2013/0186647 A1 7/2013 Xu et al.
2013/0240201 A1 9/2013 Frazier
2013/0264056 A1 10/2013 Stout
2013/0306331 A1 11/2013 Bishop et al.
2014/0020911 A1 1/2014 Martinez
2014/0027127 A1 1/2014 Frazier et al.
2014/0045731 A1 2/2014 Daccord
2014/0090831 A1 4/2014 Young et al.
2014/0116677 A1 5/2014 Sherlin
2014/0120346 A1 5/2014 Rochen
2014/0190685 A1 7/2014 Frazier et al.
2014/0224476 A1 8/2014 Frazier
2014/0251641 A1 9/2014 Marya et al.
2014/0345875 A1 11/2014 Murphree et al.
2014/0345878 A1 11/2014 Murphree et al.
2014/0374163 A1 12/2014 Rui et al.
2015/0013996 A1 1/2015 Davies et al.
2015/0027737 A1 1/2015 Rochen et al.
2015/0068728 A1 3/2015 Stage et al.
2015/0083394 A1 3/2015 Skarsen et al.
2015/0144348 A1 5/2015 Okura et al.
2015/0239795 A1 8/2015 Doud et al.
2015/0252638 A1 9/2015 Richards et al.
2015/0275070 A1 10/2015 Getzlaf et al.
2015/0354313 A1 12/2015 McClinton et al.
2015/0368994 A1 12/2015 Mhaskar et al.
2016/0115759 A1 4/2016 Richards et al.
2016/0122617 A1 5/2016 Murphree et al.
2016/0123104 A1 5/2016 Harris
2016/0130906 A1 5/2016 Garvey et al.
2016/0160591 A1 6/2016 Xu et al.

(56) References Cited

U.S. PATENT DOCUMENTS

| | | | | |
|---|---|---|---|---|
| 2016/0201427 | A1 | 7/2016 | Fripp et al. | |
| 2016/0265305 | A1 | 9/2016 | Davies et al. | |
| 2016/0281458 | A1 | 9/2016 | Greenlee | |
| 2016/0305215 | A1 | 10/2016 | Harris et al. | |
| 2016/0376869 | A1 | 12/2016 | Rochen et al. | |
| 2017/0044859 | A1 | 2/2017 | Blair | |
| 2017/0101836 | A1 | 4/2017 | Webster et al. | |
| 2017/0130553 | A1* | 5/2017 | Harris | E21B 33/1291 |
| 2017/0175488 | A1 | 6/2017 | Lisowski et al. | |
| 2017/0183950 | A1 | 6/2017 | Gillis et al. | |
| 2017/0260824 | A1 | 9/2017 | Kellner et al. | |
| 2017/0260825 | A1 | 9/2017 | Schmidt et al. | |
| 2017/0284167 | A1 | 10/2017 | Takahashi et al. | |
| 2017/0321514 | A1 | 11/2017 | Crow | |
| 2018/0171745 | A1 | 6/2018 | Jones | |
| 2019/0162044 | A1 | 5/2019 | Dirocco | |
| 2019/0169951 | A1* | 6/2019 | Frazier | E21B 33/1204 |
| 2019/0242209 | A1* | 8/2019 | Anthony | E21B 33/1212 |
| 2021/0054719 | A1* | 2/2021 | Nichols | E21B 34/12 |
| 2022/0034192 | A1* | 2/2022 | Harris | E21B 33/1291 |

FOREIGN PATENT DOCUMENTS

| | | |
|---|---|---|
| EP | 0890706 | 1/1993 |
| EP | 1643602 | 4/2006 |
| WO | 2007014339 | 2/2007 |
| WO | 2008100644 | 8/2008 |
| WO | 20091128853 | 9/2009 |
| WO | 2011097091 | 8/2011 |
| WO | 2011160183 | 12/2011 |
| WO | 2014197827 | 12/2014 |
| WO | 2016032761 | 3/2016 |
| WO | 2016182545 | 11/2016 |

* cited by examiner

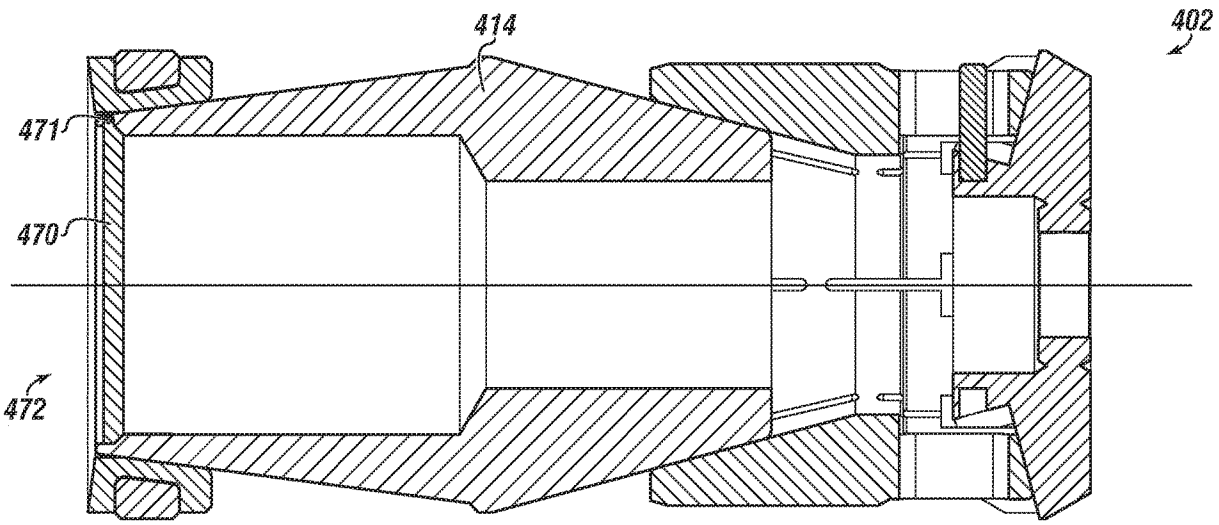
FIGURE 4A
FIGURE 4B
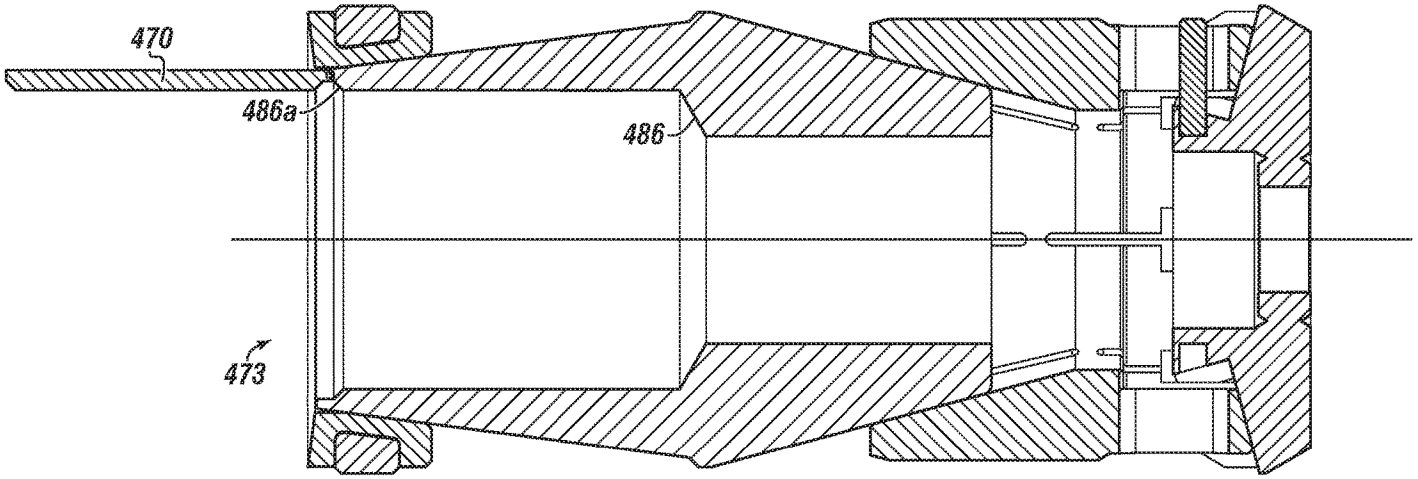

DOWNHOLE SETTING SYSTEM FOR USE IN A WELLBORE

INCORPORATION BY REFERENCE

The subject matter of U.S. non-provisional application Ser. No. 15/876,120, filed Jan. 20, 2018, Ser. Nos. 15/898,753 and 15/899,147, each filed Feb. 19, 2018, and Ser. No. 15/904,468, filed Feb. 26, 2018, is incorporated herein by reference in entirety for all purposes, including with particular respect to a composition of matter (or material of construction) for a (sub)component for a downhole tool. The subject matter of U.S. provisional application Ser. No. 62/916,034, filed Oct. 16, 2019, is incorporated herein by reference in entirety for all purposes. One or more of these applications may be referred to herein as the "Applications".

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool that may be run into a wellbore and useable for wellbore isolation, and methods pertaining to the same. In particular embodiments, the downhole tool may be a plug made of drillable materials. In other embodiments, one or more components may be made of a dissolvable material, any of which may be composite- or metal-based.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 112 (e.g., e-line, wireline, coiled tubing, etc.) and/or with setting tool 117, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

The setting tool 117 is incorporated into the workstring 112 along with the downhole tool 102. Examples of commercial setting tools include the Baker #10 and #20, and the 'Owens Go'. Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments. In these conditions, conventional tools, including those with compressible seal elements, may become ineffective from degradation. For example, the sealing element may melt, solidify, or otherwise lose elasticity, resulting in a loss the ability to form a seal barrier.

Before production operations may commence, conventional plugs typically require some kind of removal process, such as milling or drilling. Drilling typically entails drilling through the set plug, but in some instances the plug can be removed from the wellbore essentially intact (i.e., retrieval). A common problem with retrievable plugs is the accumulation of debris on the top of the plug, which may make it difficult or impossible to engage and remove the plug. Such debris accumulation may also adversely affect the relative movement of various parts within the plug. Furthermore, with current retrieving tools, jarring motions or friction against the well casing may cause accidental unlatching of the retrieving tool (resulting in the tools slipping further into the wellbore), or re-locking of the plug (due to activation of the plug anchor elements). Problems such as these often make it necessary to drill out a plug that was intended to be retrievable.

However, because plugs are required to withstand extreme downhole conditions, they are built for durability and toughness, which often makes the drill-through process difficult, time-consuming, and/or require considerable expertise. Even drillable plugs are typically constructed of a metal such as cast iron that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

Composite materials, such as filament wound materials, have enjoyed success in the frac industry because of easy-to-drill tendencies. The process of making filament wound materials is known in the art, and although subject to differences, typically entails a known process. However, even composite plugs require drilling, or often have one or more pieces of metal (sometimes hardened metal).

The use of plugs in a wellbore is not without other problems, as these tools are subject to known failure modes. When the plug is run into position, the slips have a tendency to pre-set before the plug reaches its destination, resulting in damage to the casing and operational delays. Pre-set may result, for example, because of residue or debris (e.g., sand) left from a previous frac. In addition, conventional plugs are known to provide poor sealing, not only with the casing, but also between the plug's components. For example, when the sealing element is placed under compression, its surfaces do not always seal properly with surrounding components (e.g., cones, etc.).

Downhole tools are often activated with a drop ball that is flowed from the surface down to the tool, whereby the pressure of the fluid must be enough to overcome the static pressure and buoyant forces of the wellbore fluid(s) in order for the ball to reach the tool. Frac fluid is also highly pressurized in order to not only transport the fluid into and through the wellbore, but also extend into the formation in order to cause fracture. Accordingly, a downhole tool must be able to withstand these additional higher pressures.

It is naturally desirable to "flow back," i.e., from the formation to the surface, the injected fluid, or the formation fluid(s); however, this is not possible until the previously set tool or its blockage is removed. Removal of tools (or blockage) usually requires a well-intervention service for retrieval or drill-through, which is time consuming, costly, and adds a potential risk of wellbore damage.

The more metal parts used in the tool, the longer the drill-through operation takes. Because metallic components are harder to drill, such an operation may require additional trips into and out of the wellbore to replace worn out drill bits.

In the interest of cost-saving, materials that react under certain downhole conditions have been the subject of significant research in view of the potential offered to the oilfield industry. For example, such an advanced material that has an ability to degrade by mere response to a change in its surrounding is desirable because no, or limited, intervention would be necessary for removal or actuation to occur.

Such a material, essentially self-actuated by changes in its surrounding (e.g., the presence a specific fluid, a change in temperature, and/or a change in pressure, etc.) may potentially replace costly and complicated designs and may be most advantageous in situations where accessibility is limited or even considered to be impossible, which is the case in a downhole (subterranean) environment. However, these materials tend to be exotic, rendering related tools made of such materials undesirable as a result of high cost.

Conventional, and even modern, tools require an amount of materials and components that still result in a set tool being in excess of twelve inches. A shorter tool means less materials, less parts, reduced removal time, and easier to deploy.

The ability to save cost on materials and/or operational time (and those saving operational costs) leads to considerable competition in the marketplace. Achieving any ability to save time, or ultimately cost, leads to an immediate competitive advantage.

Accordingly, there are needs in the art for novel systems and methods for isolating wellbores in a fast, viable, and economical fashion. Moreover, it remains desirable to have a downhole tool that provides a larger flowbore, but still able to withstand setting forces. There is a great need in the art for downhole plugging tools that form a reliable and resilient seal against a surrounding tubular that use less materials, less parts, have reduced or eliminated removal time, and are easier to deploy, even in the presence of extreme wellbore conditions. There is also a need for a downhole tool made substantially of a drillable material that is easier and faster to drill, or outright eliminates a need for drill-thru.

SUMMARY

Embodiments of the disclosure pertain to a downhole tool for use in a wellbore that may include any of the following: a cone mandrel comprising: a distal end; a proximate end; and an outer surface. There may be a carrier ring slidingly engaged with the distal end. The carrier ring may include an outer seal element groove. There may be a seal element disposed in the outer seal element groove. There may be a slip engaged with the proximate end. There may be a lower sleeve coupled with the slip.

The cone mandrel may be dual-frustoconical in shape. As such, the outer surface may include a first angled surface and a second angled surface. The first angled surface may include a first plane that in cross section bisects a longitudinal axis a first angle range of 5 degrees to 40 degrees. The second angled surface may be negative to the first angled surface. In aspects, the second angled surface may include a second plane that in cross section bisects the longitudinal angle negative to that of the first angle. The second angle may be in a second angle range of 5 degrees to 40 degrees.

The slip may include an at least one slip groove that forms a lateral opening in the slip. The slip groove may be defined by a first portion of slip material at a first slip end, a second portion of slip material at a second slip end. The slip groove may have a depth that extends from a slip outer surface to a slip inner surface.

The slip may have an at least one pin window adjacent the at least one slip groove. The lower sleeve may have a pin groove proximate to the at least one pin window. There may be a pin disposed within either or both of the at least one pin window and the at least one pin window.

Any component of the downhole tool may be made of a composite material. Any component of the downhole tool is made of a dissolvable material. The dissolvable material may be composite- or metal-based.

The slip may include an at least one primary fracture. The carrier ring may be configured to elongate by about 10% to 20% with respect to its original shape. The carrier ring may elongate without fracturing.

The downhole tool (or cone mandrel) may have an inner flowbore. The inner flowbore may have an inner diameter in a bore range of about 1 inch to 5 inches.

The lower sleeve may have a shear tab. In aspects, the seal element is not engaged or otherwise directly in contact with a cone. In aspects, a longitudinal length of the downhole tool after setting may be in a set length range of about 5 inches to about 15 inches.

The cone mandrel may include a ball seat formed within an inner flowbore.

Other embodiments of the disclosure pertain to a downhole setting system for use in a wellbore that may include a workstring; a setting tool assembly coupled to the workstring; and a downhole tool coupled with the setting tool assembly.

The setting tool may include a tension mandrel having a first tension mandrel end and a second tension mandrel end. The setting tool assembly may include a setting sleeve.

The downhole tool may include: a cone mandrel comprising: a distal end; a proximate end; and an outer surface. The downhole tool may have a carrier ring slidingly engaged with the distal end. The carrier ring may include an outer seal element groove. There may be a seal element disposed in the outer seal element groove. There may be a slip engaged with the proximate end. There may be a lower sleeve coupled with the slip.

The tension mandrel may be disposed through the downhole tool. There may be a nose nut is engaged with each of the second tension mandrel end and the lower sleeve.

The outer surface of the cone mandrel may be dual frustoconical. Thus, there may be a first angled surface and a second angled surface. The first angled surface may include a first plane that in cross section bisects a longitudinal axis a first angle range of 5 degrees to 40 degrees. The second angled surface may include a second plane that in cross section bisects the longitudinal angle negative to that of the first angle. The second angle may be in a second angle range of (negative) 5 degrees to 40 degrees.

The cone mandrel may include a ball seat formed within an inner flowbore.

Any component of the downhole tool may be made of a polymer-based material. Any component of the downhole tool may be made of a metallic-based material.

Embodiments of the disclosure pertain to a downhole tool suitable for use in a wellbore. The downhole tool may include a mandrel made of a reactive material, which may be metallic-based. The mandrel may include a distal end; a proximate end; and an outer surface.

The unset downhole tool may be about 4 inches to about 20 inches in longitudinal length. The downhole tool in its fully set position may be less than 15 inches in longitudinal length.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 4A shows a longitudinal side cross-sectional view of a downhole tool having a flapper according to embodiments of the disclosure; and FIG. 4B shows a longitudinal side cross-sectional view of the downhole tool of FIG. 4A with the flapper open according to embodiments of the disclosure.

DETAILED DESCRIPTION

Figure 1:
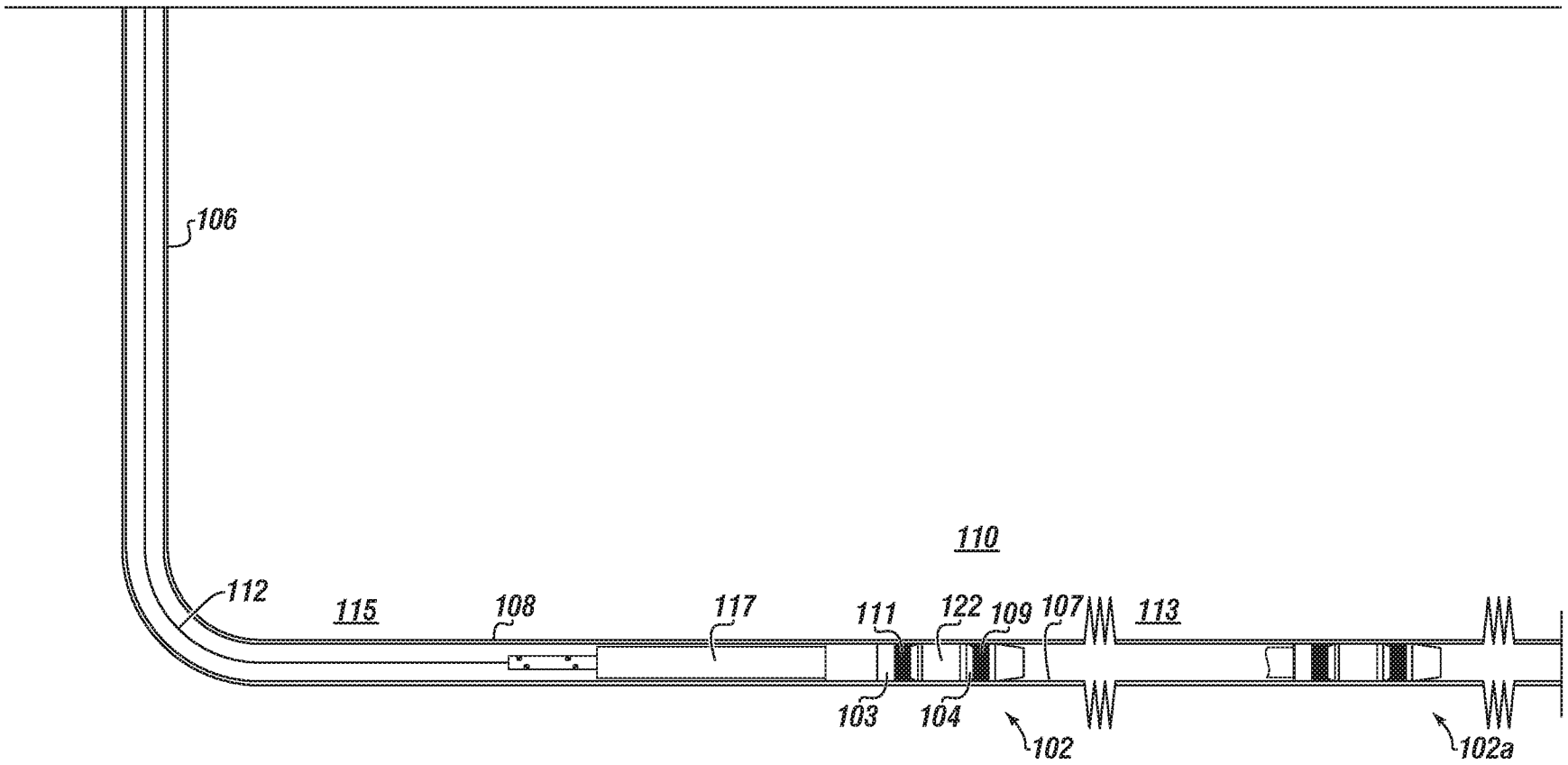
FIGURE 1 (PRIOR ART)
FIG. 1 is a side view of a process diagram of a conventional plugging system.

Herein disclosed are novel apparatuses, systems, and methods that pertain to and are usable for wellbore operations, details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "composition" or "composition of matter" as used herein may refer to one or more ingredients, components, constituents, etc. that make up a material (or material of construction). Composition may refer to a flow stream, or the material of construction of a component of a downhole tool, of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac operation" as used herein may refer to fractionation of a downhole well that has already been drilled. 'Frac operation' can also be referred to and interchangeable with the terms fractionation, hydrofracturing, hydrofracking, fracking, fracing, frac, and the like. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "reactive material" as used herein may refer a material with a composition of matter having properties and/or characteristics that result in the material responding to a change over time and/or under certain conditions. The term reactive material may encompass degradable, dissolvable, disassociatable, dissociable, and so on.

The term "degradable material" as used herein may refer to a composition of matter having properties and/or characteristics that, while subject to change over time and/or under certain conditions, lead to a change in the integrity of the material. As one example, the material may initially be hard, rigid, and strong at ambient or surface conditions, but over time (such as within about 12-36 hours) and under certain conditions (such as wellbore conditions), the material softens.

The term "dissolvable material" may be analogous to degradable material. The term as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-36 hours) and under certain conditions (such as wellbore conditions), the material softens. As another example, the material may initially be hard, rigid, and strong at ambient or surface conditions, but over time (such as within about 12-36 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "breakable material" as used herein may refer to a composition of matter having properties and/or characteristics that, while subject to change over time and/or under certain conditions, lead to brittleness. As one example, the material may be hard, rigid, and strong at ambient or surface conditions, but over time and under certain conditions, becomes brittle. The breakable material may experience breakage into multiple pieces, but not necessarily dissolution.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "machined" can refer to a computer numerical control (CNC) process whereby a robot or machinist runs computer-operated equipment to create machine parts, tools and the like.

The term "plane" or "planar" as used herein may refer to any surface or shape that is flat, at least in cross-section. For example, a frusto-conical surface may appear to be planar in 2D cross-section. It should be understood that plane or planar need not refer to exact mathematical precision, but instead be contemplated as visual appearance to the naked eye. A plane or planar may be illustrated in 2D by way of a line.

The term "parallel" as used herein may refer to any surface or shape that may have a reference plane lying in the same direction or vector as that of another. It should be understood that parallel need not refer to exact mathematical precision, but instead be contemplated as visual appearance to the naked eye.

The term "cone mandrel" as used herein may refer to a tubular component having an at least one generally frusto-conical surface. The cone mandrel may have an external surface that in cross section has a reference line/plane bisecting a reference axis at an angle. The cone mandrel may be a dual (also "dual faced", "double faced, and the like) cone, meaning there may be a second external surface having a second reference line/plane bisecting the reference axis (in cross-section) at a second angle. The second angle may be negative to the first angle (e.g., +10 degrees for the first, −10 degrees for the second).

Figures 2A, 2B:
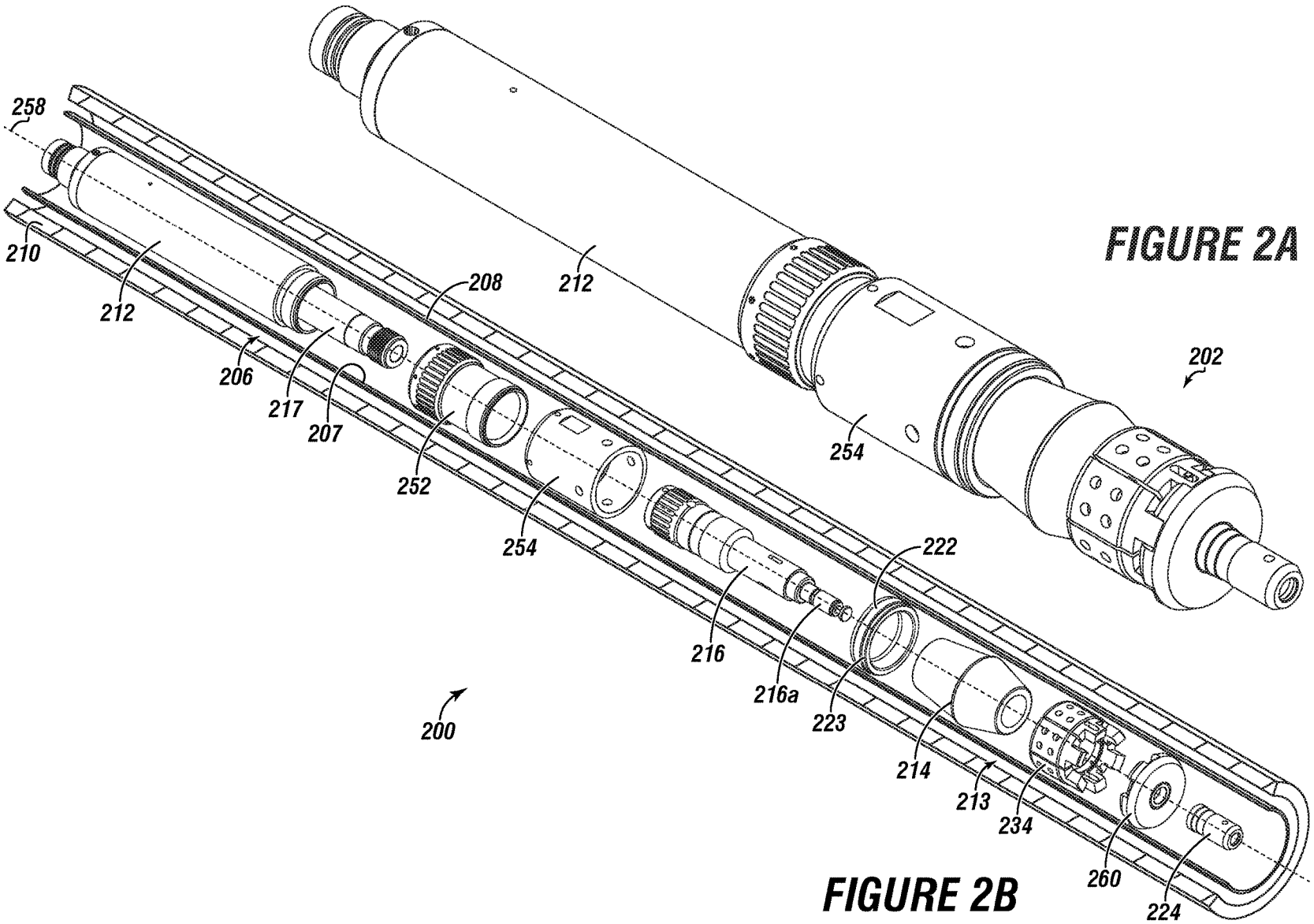
FIG. 2A shows an isometric view of a system having a downhole tool, according to embodiments of the disclosure.
FIG. 2B shows an isometric breakout view of a system having a downhole tool, according to embodiments of the disclosure.

Referring now to FIGS. 2A and 2B together, isometric views of a system 200 having a downhole tool 202 illustrative of embodiments disclosed herein, are shown. FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented), and the like.

A workstring 212 (which may include a setting tool [or a part 217 of a setting tool] configured with an adapter 252) may be used to position or run the downhole tool 202 into and through the wellbore 206 to a desired location. One of skill would appreciate the setting tool may be like that provided by Baker or Owen. The setting tool assembly 217 may include or be associated with a setting sleeve 254. The setting sleeve 254 may be engaged with the downhole tool (or a component thereof) 202.

The setting tool may include a tension mandrel 216 associated (e.g., coupled) with an adapter 252. In an embodiment, the adapter 252 may be coupled with the setting tool (or part thereof) 217, and the tension mandrel 216 may be coupled with the adapter 252. The coupling may be a threaded connection (such as via threads on the adapter 252 and corresponding threads of the tension mandrel 216—not shown here). The tension mandrel 216 may extend, at least partially, out of the (bottom/downhole/distal end) tool 202.

An end or extension 216*a* of the tension mandrel 216 may be coupled with a nose sleeve or nut 224. The nut 224 may have a threaded connection 225 with the end 216*a* (and thus corresponding mating threads), although other forms of coupling may be possible. For additional securing, one or more set screws 226 may be disposed through set screw holes 227 and screwed into or tightened against the end 216*a*. The nut 224 may engage or abut against a shear tab of a lower sleeve 260.

The downhole tool 202, as well as its components, may be annular in nature, and thus centrally disposed or arranged with respect to a longitudinal axis 258. In accordance with embodiments of the disclosure, the tool 202 may be configured as a plugging tool, which may be set within the tubular 208 in such a manner that the tool 202 forms a fluid-tight seal against the inner surface 207 of the tubular 208. The seal may be facilitated by a seal element 222 expanded into a sealing position against the inner surface 207. The seal element 222 may be supported by a carrier ring 223. The carrier ring 223 may be disposed around a cone mandrel 214. Once set, the downhole tool 202 may be held in place by use of an at least one slip 234. The slip 234 may have a one-piece configuration.

In an embodiment, the downhole tool 202 may be configured as a bridge plug, whereby flow from one section of the wellbore to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball (e.g., 285, FIG. 2E) may be dropped into the wellbore 206 and flowed into the tool 202 and come to rest in a corresponding ball seat (286) at the end of the cone mandrel 214. The seating of the ball may provide a seal within the tool 202 resulting in a plugged condition, whereby a pressure differential across the tool 202 may result. The ball seat may include a radius or curvature. The radius or curvature may be convex or concave in nature.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation 210 with any of these configurations.

Once the tool 202 reaches the set position within the tubular, the setting mechanism or workstring 212 may be detached from the tool 202 by various methods, resulting in the tool 202 left in the surrounding tubular 208 and one or more sections (e.g., 213) of the wellbore 206 isolated. In an embodiment, once the tool 202 is set, tension may be applied to the setting tool (217) until a shearable connection between the tool 202 and the workstring 212 is broken. However, the downhole tool 202 may have other forms of disconnect. The amount of load applied to the setting tool and the shearable connection may be in the range of about, for example, 20,000 to 55,000 pounds force.

In embodiments the tension mandrel 216 may separate or detach from a lower sleeve 260 (directly or indirectly)), resulting in the workstring 212 being able to separate from the tool 202, which may be at a predetermined moment. The loads provided herein are non-limiting and are merely exemplary. The setting force may be determined by specifically designing the interacting surfaces of the tool 202 and the respective tool surface angles. The tool 202 may also be configured with a predetermined failure point (not shown) configured to fail, break, or otherwise induce fracture. For example, the lower sleeve 260 may be configured with a groove having an association with the shearable connection or tab, the groove being suitable to induce proximate fracture.

Operation of the downhole tool 202 may allow for fast run in of the tool 202 to isolate one or more sections of the wellbore 206, as well as quick and simple drill-through or dissolution to destroy or remove the tool 202.

Accordingly, in some embodiments, drill-through may be completely unnecessary. As such the downhole tool 202 may have one or more components made of a reactive material, such as a metal or metal alloys. The downhole tool 202 may have one or more components made of a reactive material (e.g., dissolvable, degradable, etc.), which may be composite- or metal-based.

It follows then that one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after setting of the downhole tool 202.

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components of the tool 202 may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components of tool 202 may be made of non-dissolvable materials (e.g., materials suitable for and are known to withstand downhole environments [including extreme pressure, temperature, fluid properties, etc.] for an extended period of time (predetermined or otherwise) as may be desired).

The downhole tool 202 (and other tool embodiments disclosed herein) and/or one or more of its components may be 3D-printed or made with other forms of additive manufacturing.

Figure 2C:
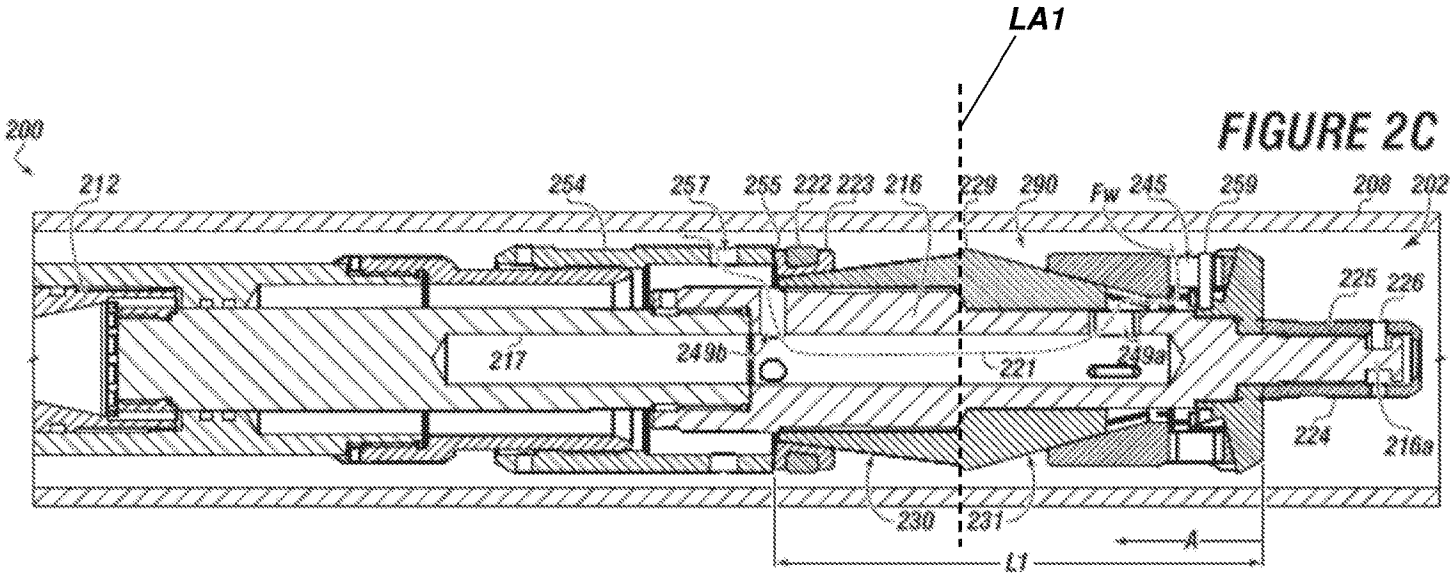
FIG. 2C shows a longitudinal side cross-sectional view of an unset downhole tool according to embodiments of the disclosure.
Figure 2D:
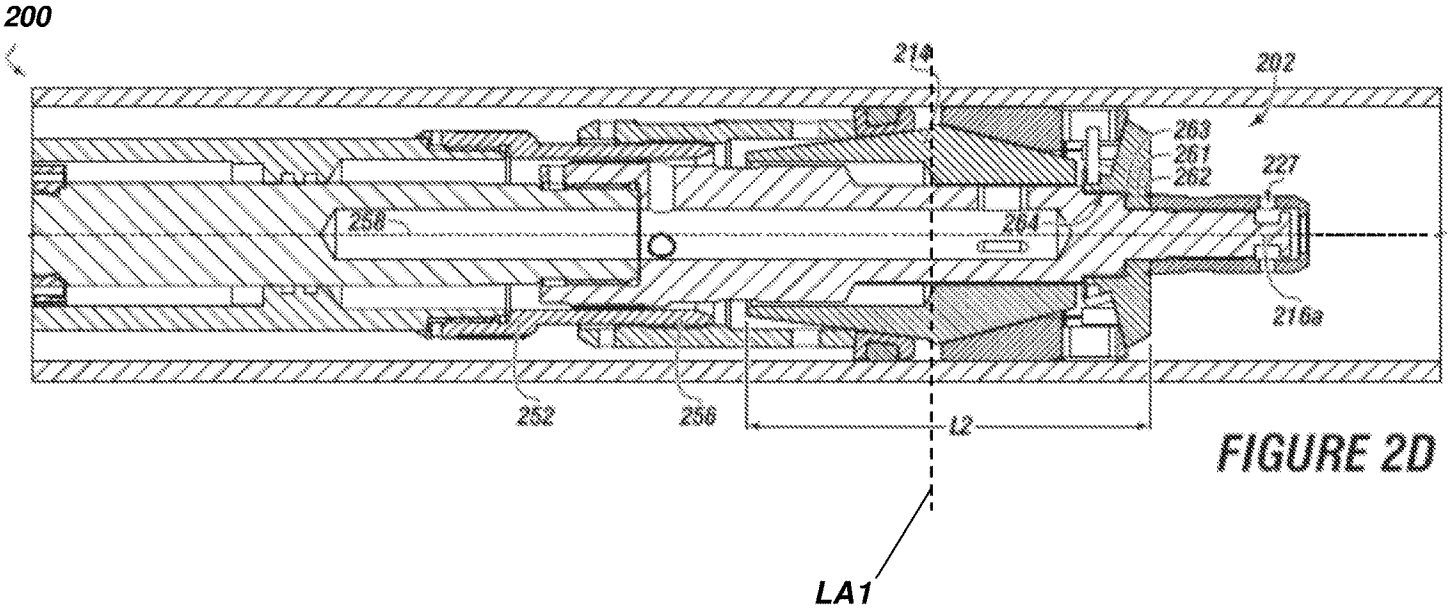
FIG. 2D shows a longitudinal side cross-sectional view of the downhole tool of FIG. 2C in a set position according to embodiments of the disclosure.
Figure 2E:
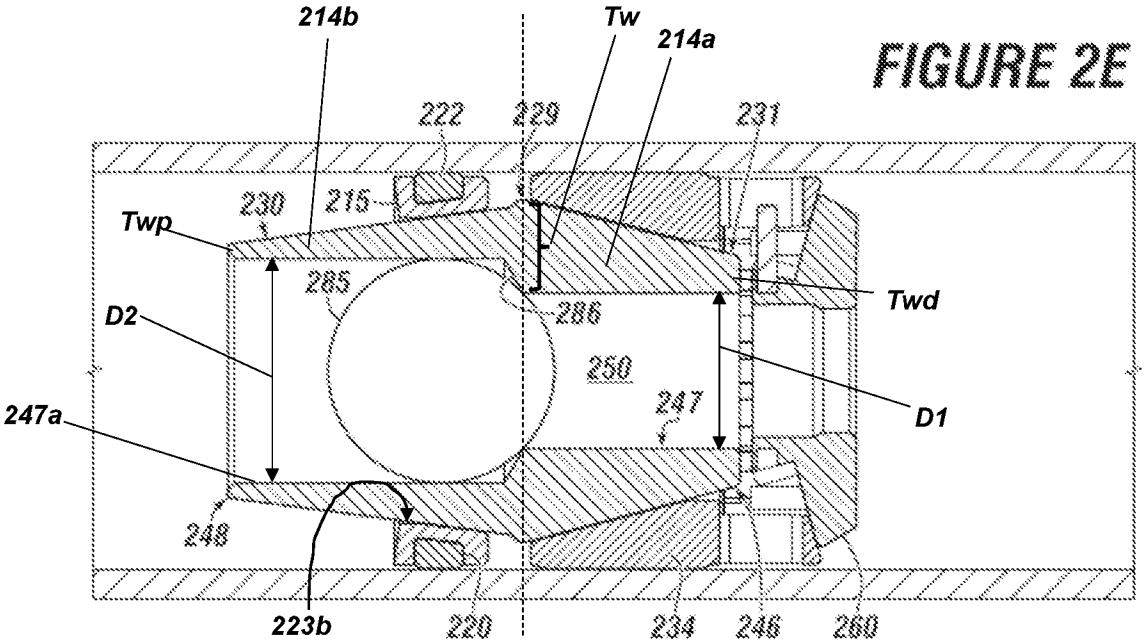
FIG. 2E shows a longitudinal side cross-sectional view of the downhole tool of FIG. 2C in a set position and disconnected from a workstring according to embodiments of the disclosure.

Referring now to FIGS. 2C-2E together, a longitudinal side cross-sectional view of a system having an unset downhole tool, a set downhole tool, and a set downhole tool disconnected from a workstring, respectively, according to embodiments of the disclosure, are shown. The setting device(s) and components of the downhole tool 202 may be coupled with, and axially and/or longitudinally movable, at least partially, with respect to each other.

The downhole tool 202 may include a cone mandrel 214 that extends through the tool 202 (or tool body). The cone mandrel 214 may be a solid body. In other aspects, the cone mandrel 214 may include a flowpath or bore 250 formed therein (e.g., an axial bore, inner flowbore, etc.). The bore 250 may extend partially or for a short distance through the cone mandrel 214. Alternatively, the bore 250 may extend through the entire mandrel 214, with an opening at its proximate end 248 and oppositely at its distal end 246 (near downhole end of the tool 202), as illustrated by FIG. 2E.

The presence of the bore 250 or other flowpath through the cone mandrel 214 may indirectly be dictated by operating conditions. That is, in most instances the tool 202 may be large enough in diameter (e.g., 4¾ inches) that the bore 250 may be correspondingly large enough (e.g., 1¼ inches) so that debris and junk may pass or flow through the bore 250 without plugging concerns.

With the presence of the bore 250, the cone mandrel 214 may have an inner bore surface 247, which may be smooth and annular in nature. In cross-section, the bore surface 247 may be planar. In embodiments, the bore surface 247 (in cross-section) may be parallel to a (central) tool axis 258. An outer mandrel surface 230 may have one or more surfaces (in cross-section) offset or angled to the tool axis 258.

The bore 250 (and thus the tool 202) may be configured for part of a setting tool assembly 217 to fit therein, such as a tension mandrel 216. Thus, the tension mandrel 216, which may be contemplated as being part of the setting tool assembly 217, may be configured for the downhole tool 202 (or components thereof) to be disposed therearound (such as during run-in). In assembly, the downhole tool 202 may be coupled with the setting tool assembly 217 (and around the tension mandrel 216), but not in a threaded manner. In an embodiment, the downhole tool 202 (by itself, and not including setting tool components) may be completely devoid of threaded connections. If used, an adapter 252 may include threads 256 thereon. Such threads 256 may correspond to mate with threads of the setting sleeve 254.

As shown, a lower sleeve 260 may be configured with a shear point, such as the shear tab 261. The shear tab 261 may be engaged with the setting tool assembly 217. As shown, the shear tab 261 may be engaged or proximate to each of the tension mandrel 216 and the nose nut 224. The lower sleeve 260 (or the shear point) may be configured to facilitate or promote deforming, and ultimately shearing/breaking, during setting. As such, the shear tab 261 may have at least one recess region or fracture groove 262 (tantamount to a predetermined and purposeful failure point of the lower sleeve 260).

The groove 262 may be circumferential around the tab 261. In embodiments the recess region 262 may be in the form of a v-notch or other shape or configuration suitable to allow the tab 261 to break free from the lower sleeve 260. The shear tab 261 may be configured to shear at a predetermined point. The shear tab 261 may be disposed within an inner lower sleeve bore 264, and protrude (or extend) radially inward in a circumferential manner There may be other recessed regions 263. During setting, as the tension mandrel 216 continues to be pulled in direction A, the nut 224 will continue to exert force on the shear tab 261, ultimately resulting in shearing the tab. The shear tab 261 may be configured to shear at a load greater than the load for setting the tool 206.

The downhole tool 202 may be run into wellbore (206) to a desired depth or position by way of the workstring 212 that may be configured with the setting tool assembly 217. The workstring 212 and setting sleeve 254 may be part of the tool system 200 utilized to run the downhole tool 202 into the wellbore and activate the tool 202 to move from an unset to set position. The set position of the tool 202 (see FIG. 2E) may include a seal element 222 and/or slip 234 engaged with the tubular 208. In an embodiment, the setting sleeve 254 (that may be configured as part of the setting tool assembly) may be utilized to force or urge (directly or indirectly) expansion of the seal element 222 into sealing engagement with the surrounding tubular 208. The set position shown in 2E may include the downhole tool 202 engaged with the surrounding surface 207. The tension mandrel 216 may be disconnected from the downhole tool 202 and removed from the inner flowbore 250.

During run-in, an annulus 290 around the tool 202 may small or narrow enough that an undesirable pressure (or resistance) builds in front of the tool 202. As such, the tool 202 (in conjunction with the setting tool assembly 217) may provide a fluid (pressure) bypass flowpath 221. As shown in FIG. 2C, wellbore fluid Fw may enter a side (pin) window 245 of the slip 234, and then through a bottom side port 249*a* of the tension mandrel 216. The fluid Fw may exit from the tension mandrel 216 via upper side port 249*b*, and then out a setting sleeve side port 257 back into the annulus 290.

The setting device(s) and components of the downhole tool 202 may be coupled with, and axially and/or longitudinally movable along or in a working relationship with the cone mandrel 214. When the setting sequence begins, the lower sleeve 260 may be pulled via tension mandrel 216 while the setting sleeve 254 remains stationary.

As the tension mandrel 216 is pulled in the direction of Arrow A, one or more the components disposed about mandrel 214 between the distal end 246 and the proximate end 248 may begin to compress against one another as a result of the setting sleeve 254 (or end 255) held in place against carrier ring end surface 215. This force and resultant movement may urge the carrier ring 223 to compressively slide against an upper cone surface 230 of the cone mandrel 214, and ultimately expand (along with the seal element 222). Thus, the carrier ring 223 may be slidingly engaged with the cone mandrel 214. As shown here by way of comparison in FIGS. 2C and 2E, whether the downhole tool 202 is in a set position or an unset position, an underside surface 223*b* of the carrier ring 223 may be entirely engaged with the outer surface 230. In the set position of 2E, the carrier ring 223 may be only in contact with the cone 214, and no other component of the downhole tool 202 (not including the optional seal element 222). Although not shown here, the carrier ring may be slidingly, sealingly engaged with the cone mandrel, such as via the use of one or more o-rings (which may be disposed in an o-ring groove on the underside of the cone mandrel).

One of skill would appreciate that the carrier ring 223 may be made of material suitable to achieve an amount of elongation necessary so that the seal element 222 disposed within the ring 223 may sealingly engage against the tubular 208. The amount of elongation may be in an elongation range of about 5% to about 25%—without fracture—as compared to an original size of the ring 223.

As the lower sleeve 260 is pulled further in the direction of Arrow A, the lower sleeve 260 (being engaged with the slip 234) may urge the slip 234 to compressively slide against a bottom cone surface 231 of the cone mandrel 214. As it is desirous for the slip 234 to fracture, the slip 234 need not have any elongation of significance. As fracture occurs, the slip (or segments thereof) 234 may also move radially outward into engagement with the surrounding tubular 208.

The slip 234 may have gripping elements, such as wickers, buttons, inserts or the like. In embodiments, the gripping elements may be serrated outer surfaces or teeth of the slip(s) may be configured such that the surfaces prevent the respective slip (or tool) from moving (e.g., axially or longitudinally) within the surrounding tubular 208, whereas otherwise the tool 202 may inadvertently release or move from its position.

From the drawings it would be apparent that the seal element 222 (or carrier ring 223) need not be in contact with the slip 234. Where the surfaces 230, 231 converge, there may be a crest or mandrel ridge 229. The crest 229 may be an outermost, central point of the cone mandrel 214. Thus, the crest 229 may have a crest wall thickness Tw corresponding to the widest (thickest) point of the mandrel 214. Notably the wall thickness Twd and/or Twp may be at its least point of thickness at the respective distal and proximate ends 246, 248. As such, the crest wall thickness Tw at the crest 229 may be greater than either or both of the wall thickness Twd, Twp at the ends 246, 248. The crest 229 may beneficially limit any chance of undesirable extrusion, and may further prevent such contact between the slip 234 and the seal element 222. The Figures further illustrate that the slip 234 may be proximate to the first or distal end 246 of the cone mandrel 214, whereas the seal element 222 may be proximate to the second or proximate end 248 of the cone mandrel 214.

Because the sleeve 254 is held rigidly in place, the sleeve 254 may engage against load bearing end 215 of the carrier ring 223 that may result in at least partial transfer of load through the rest of the tool 202. The setting sleeve 254 may have a sleeve end 255 that abuts against the end 215. However, ring 223 will be urged against the cone mandrel 214 as the mandrel 214 is pulled.

The same effect, albeit in opposite direction may be felt by the slip 234. That is, the cone mandrel 214 may eventually reach a (near) stopping point, and the easiest degree of movement (and path of least resistance) is the slip 234 being urged by the lower sleeve 260 against the bottom cone surface 231. As a result, the slip 234 (or its segments) may urge outward and into engagement with the surrounding tubular 208.

In the event inserts (e.g., 378, FIG. 3A) are used, one or more may have an edge or corner suitable to provide additional bite into the tubular surface. In an embodiment, any of the inserts may be mild steel, such as 1018 heat treated steel, or other materials such as ceramic. Any insert may have a hole in it.

In an embodiment, slip 234 may be a one-piece slip, whereby the slip 234 has at least partial connectivity across its entire circumference. Meaning, while the slip 234 itself may have one or more grooves (or undulation, notch, etc.) configured therein, the slip 234 itself has no initial circumferential separation point. In an embodiment, the grooves of the slip may be equidistantly spaced or disposed therein.

The tool 202 may be configured with ball plug check valve assembly that includes a ball seat 286. The seat 286 may be removable or integrally formed therein. In an embodiment, the bore 250 of the cone mandrel 214 may be configured with the ball seat 286 formed or removably disposed therein. In some embodiments, the ball seat 286 may be integrally formed within the bore 250 of the cone mandrel 214. In other embodiments, the ball seat 286 may be separately or optionally installed within the cone mandrel 214, as may be desired. The ball seat 286 may be defined by inner bore 250 having a first inner diameter D1 smaller than a second inner diameter D2, as shown in FIG. 2C. Or put another way, there may be a first portion 214*a* of the cone mandrel 214 having a first inner surface 247 with the first inner diameter D1, and there may be a second portion 214*b* of the cone mandrel 214 having a second inner surface 247*a* with the second inner diameter D2. The first inner surface 247 may have a constant inner diameter D1 from the ball seat 286 to the distal end 246. The second inner surface 247*a* may have a constant inner diameter D2 from the proximate end 248 to the ball seat. Regardless of the unset position (e.g., FIG. 2C) or the set position (e.g., FIG. 2D), a relative position of the ball seat 286 is disposed between the carrier ring 215 and the slip 234, as illustrated by a lateral axis reference LA1 perpendicular to the longitudinal axis 258.

The ball seat 286 may be configured in a manner so that a ball 285 may seat or rest therein, whereby the flowpath through the cone mandrel 214 may be closed off (e.g., flow through the bore 250 is restricted or controlled by the presence of the ball). For example, fluid flow from one direction may urge and hold the ball against the seat 286, whereas fluid flow from the opposite direction may urge the ball off or away from the seat 286. As such, the ball may be used to prevent or otherwise control fluid flow through the tool 202. The ball may be conventionally made of a composite material, phenolic resin, etc., whereby the ball may be capable of holding maximum pressures experienced during downhole operations (e.g., fracing).

While not limited, a diameter of the ball 285 may be in in a ball diameter range of about 1 inch to about 5 inches. The bore 250 may have an inner bore diameter in a bore diameter range of about 1 inch to about 5 inches. As such, the cone mandrel 214 may have suitable wall thickness to handle load and prevent collapse.

The tool 202 may be configured as a drop ball plug, such that a drop ball may be flowed to the ball seat. The drop ball may be much larger diameter than the ball seat. In an embodiment, end 248 may be configured with the seat 286 such that the drop ball may come to rest and seat at in the seat 286 at the proximate end 248. As applicable, the drop ball 285 may be lowered into the wellbore and flowed toward the seat 286 formed within the tool 202.

The drop ball (or "frac ball") may be any type of ball apparent to one of skill in the art and suitable for use with embodiments disclosed herein. Although nomenclature of 'drop' or 'frac' ball is used, any such ball may be a ball held in place or otherwise positioned within a downhole tool. The ball may be tethered to the tool 202 (or any component thereof). The tethered ball may be as provided for in U.S. Non-Provisional patent application Ser. No. 16/387,985, filed Apr. 18, 2019, and incorporated herein by reference in its entirety for all purposes, including as it pertains to a tethered ball.

The ball may be a "smart" ball (not shown here) configured to monitor or measure downhole conditions, and otherwise convey information back to the surface or an operator, such as the ball(s) provided by Aquanetus Technology, Inc. or OpenField Technology In other aspects, the ball 285 may be made from a composite material. In an embodiment, the composite material may be wound filament. Other materials are possible, such as glass or carbon fibers, phenolic material, plastics, fiberglass composite (sheets), plastic, etc.

The drop ball 285 may be made from a dissolvable material, such as that as disclosed in U.S. patent application Ser. No. 15/784,020, and incorporated herein by reference as it pertains to dissolvable materials. The ball may be configured or otherwise designed to dissolve under certain conditions or various parameters, including those related to temperature, pressure, and composition.

Although not shown here, the downhole tool 202 may have a pumpdown ring or other suitable structure to facilitate or enhance run-in. The downhole tool 202 may have a 'composite member' like that described in U.S. Pat. No. 8,955,605, incorporated by reference herein in its entirety for all purposes, particularly as it pertains to the composite member.

In other aspects, the tool 202 may be configured as a bridge plug, which once set in the wellbore, may prevent or allow flow in either direction (e.g., upwardly/downwardly, etc.) through tool 202. Accordingly, it should be apparent to one of skill in the art that the tool 202 of the present disclosure may be configurable as a frac plug, a drop ball plug, bridge plug, etc. simply by utilizing one of a plurality of adapters or other optional components. In any configuration, once the tool 202 is properly set, fluid pressure may be increased in the wellbore, such that further downhole operations, such as fracture in a target zone, may commence.

The tool 202 may include an anti-rotation assembly that includes an anti-rotation device or mechanism, which may be a spring, a mechanically spring-energized composite tubular member, and so forth. The device may be configured and usable for the prevention of undesired or inadvertent movement or unwinding of the tool 202 components.

The anti-rotation mechanism may provide additional safety for the tool and operators in the sense it may help prevent inoperability of tool in situations where the tool is inadvertently used in the wrong application. For example, if the tool is used in the wrong temperature application, components of the tool may be prone to melt, whereby the device and lock ring may aid in keeping the rest of the tool together. As such, the device may prevent tool components from loosening and/or unscrewing, as well as prevent tool 202 unscrewing or falling off the workstring 212.

Of great significance, the downhole tool 202 may have an assembled, unset length L1 of less than about 6 inches. In embodiments the downhole tool 202 may have a length L1 in a range of about 3.5 inches to about 15 inches. As a result of the setting sequence, the set downhole tool 202 may have a set length L2 that is less than the length L1.

Figure 3A:
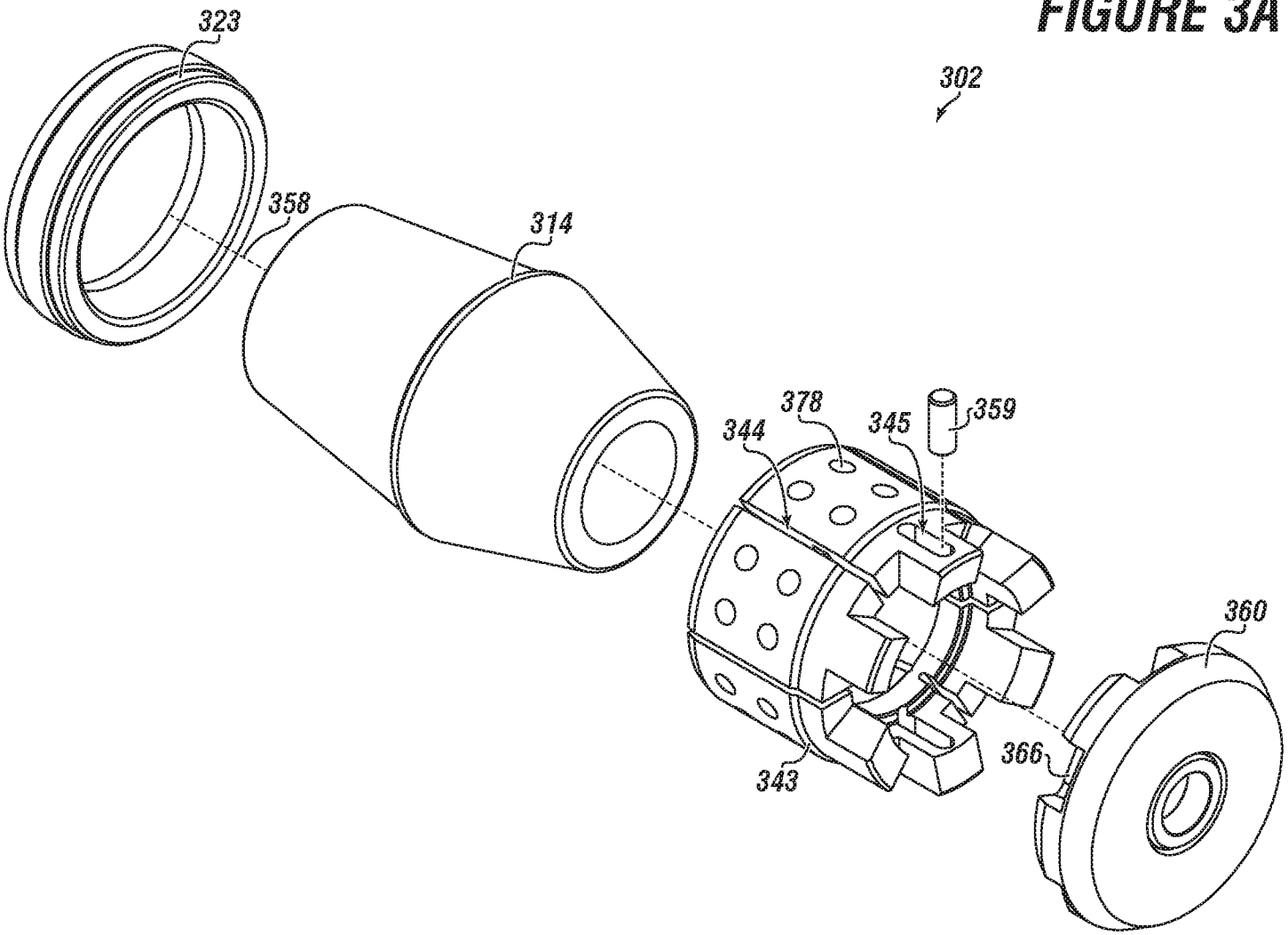
FIG. 3A shows an isometric component breakout view of a downhole tool according to embodiments of the disclosure.
Figure 3B:
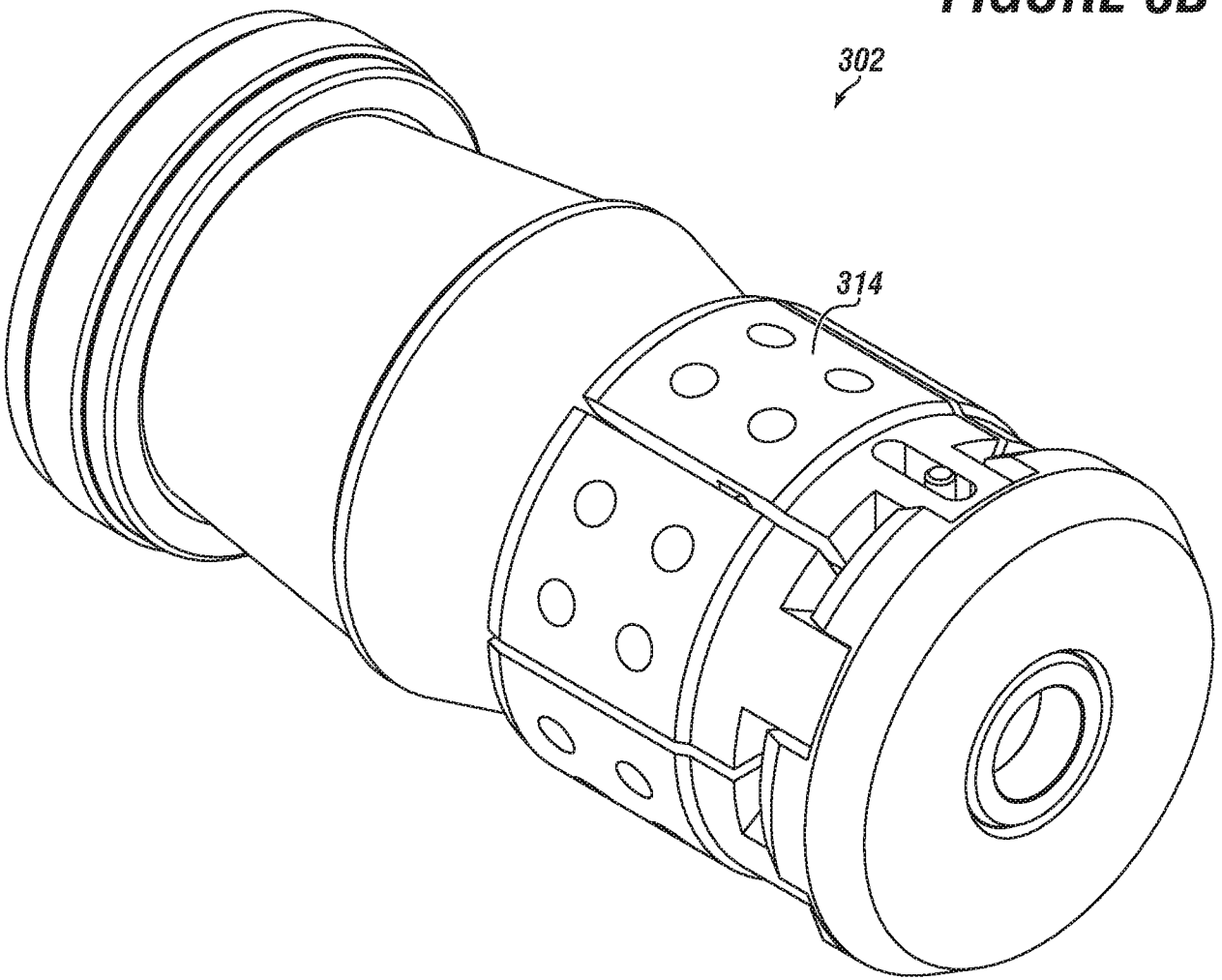
FIG. 3B shows an isometric assembled view of the downhole tool of FIG. 3A according to embodiments of the disclosure.
Figure 3C:
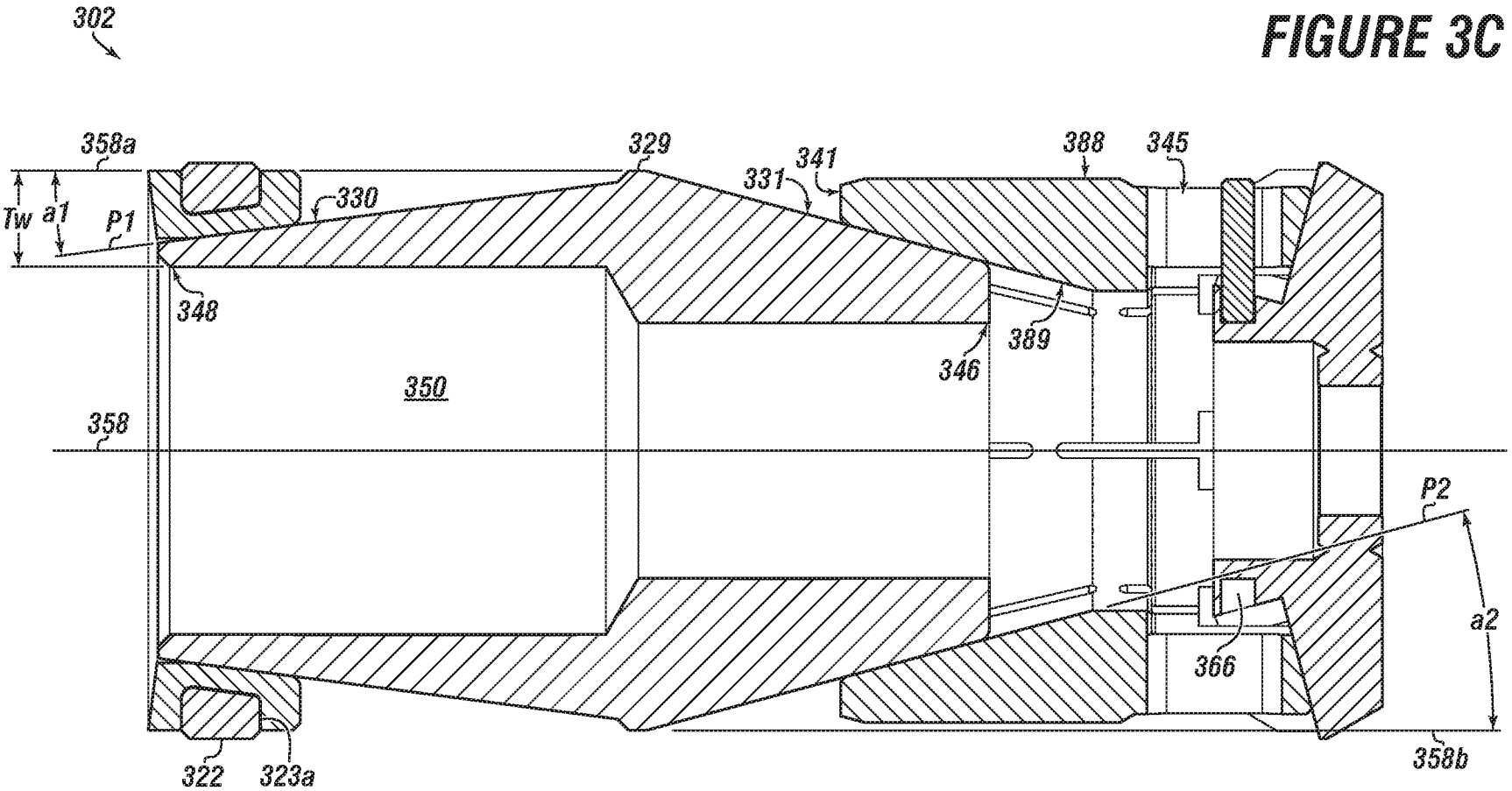
FIG. 3C shows a longitudinal side cross-sectional view of the downhole tool of FIG. 3B according to embodiments of the disclosure.

Referring now to FIGS. 3A, 3B, and 3C together, an isometric component breakout view, an isometric assembled view, and a longitudinal side cross-sectional view, respectively, of a downhole tool, in accordance with embodiments disclosed herein, are shown.

Downhole tool 302 may be run, set, and operated as described herein and in other embodiments (such as in System 200, and so forth), and as otherwise understood to one of skill in the art. Components of the downhole tool 302 may be arranged and disposed about a cone mandrel 314, as described herein and in other embodiments, and as otherwise understood to one of skill in the art. Thus, downhole tool 302 may be comparable or identical in aspects, function, operation, components, etc. as that of other tool embodiments disclosed herein. Similarities may not be discussed for the sake of brevity.

Operation of the downhole tool 302 may allow for fast run in of the tool 302 to isolate one or more sections of a wellbore as provided for herein. Drill-through of the tool 302 may be facilitated by one or more components and sub-components of tool 302 made of drillable material that may be measurably quicker to drill through than those found in conventional plugs, and/or made of reactive materials that may make drilling easier, or even outright alleviate any need.

The downhole tool 302 may have one or more components, such as a slip 334 and carrier ring 323, which may be made of a material as described herein and in accordance with embodiments of the disclosure. Such materials may include composite material, such as filament wound material, reactive material (metals or composites), and so forth. Filament wound material may provide advantages to that of other composite-type materials, and thus be desired over that of injection molded materials and the like. Other materials for the tool 302 (or any of its components) may include dissolving thermoplastics, such as PGA, PLL, and PLA.

One of skill would appreciate that in an assembled configuration (such as that of FIG. 3B) and not connected with a setting tool (217), one or more components of the tool 302 may be susceptible to falling free from the tool. As such, one or more components may be bonded (such as with a glue) to another in order to give the tool 302 an ability to hold together without the presence of the setting tool. Any such bond need not be of any great strength. In embodiments, the components of the tool 302 may be snugly press fit together.

The cone mandrel 314 may extend through the tool (or tool body) 302 in the sense that components may be disposed therearound. The mandrel 314 may include a flowpath or bore 350 formed therein (e.g., an axial bore), which may correspond a bore of the tool 302. The bore 350 may extend partially or for a short distance through the mandrel 314. Alternatively, the bore 350 may extend through the entire mandrel 314, with an opening at its proximate end 348 and oppositely at its distal end 346. The bore 350 may be configured to accommodate a setting tool (or component thereof, e.g., 216, FIG. 2D) fitting therein.

FIG. 3C illustrates in longitudinal cross-section how the cone mandrel 314 may have a first outer cone surface 330 and a second outer cone surface 331 that may be generally planar. Thus, the first outer cone surface 330 and the second outer cone surface 331 may have respective reference planes P1, P2. The planes P1, P2 (and the outer surfaces 330, 331) may be offset from a long axis 358 of the tool 302 (or respective longitudinal axis or reference planes 358 *a,b* by an angle a1 and a2 respectively. That is, the plane P1 may bisect the long axis 358 (or axis 358*a*) at the angle a1, and the plane P2 may bisect the long axis 358 (or axis 358*b*). The angles a1 and a2 may be equal and opposite to another. For example, the second angle a2 may be negative to the first angle a1 (e.g., +10 degrees for the first, −10 degrees for the second), and thus providing the 'dual' cone shape of the mandrel 314. One of skill would appreciate that a perpendicular bisect of 358 would correspondingly be a perpendicular bisect to 358 *a,b*. FIG. 3A illustrates the cone mandrel 314 may have outer surfaces 330, 331 that are void of threads or threading.

In embodiments, the angle of a1 and/or a2 may be in an angle range of about 5 degrees to about 10 degrees. Angles of the cone mandrel surface(s) described herein may be negative to that of others, with one of skill understanding a positive or negative angle is not of consequence, and instead is only based on a reference point. An angle may be an 'absolute' angle is meant refer to angles in the same magnitude of degree, and not necessarily of direction or orientation.

In embodiments, the angles a1 and a2 may be substantially equal (albeit opposite) to each other in the assembled or run-in configuration. Thus, each of the angles a1 and a2 may be in the range of about 5 degrees to about 10 degrees with respect to a reference axis. At the same time a1 and a2 may be equal to each other in magnitude (within a tolerance of less than 0.5 degrees) at about 7.5 degrees. The angles a1 and a2 may be in a range of 5 degrees to 40 degrees, and may differ from each other. For example, a1 may be about 8 degrees, and a2 may be −20 degrees.

Where the surfaces 330, 331 converge, there may be a crest 329. The crest 329 may be an outermost, central point of the cone mandrel 314. Thus, a wall thickness Tw may be at its widest (thickest) point at the crest 329. Notably the wall thickness may be at its least point at the respective ends 346, 348. As such, the wall thickness Tw at the crest 329 may be greater than either or both of the wall thickness Tw at the ends 346, 348. The crest 329 may beneficially limit any chance of undesirable extrusion.

The downhole tool 302 may include a seal element 322 disposed within and/or around the carrier ring 323. The seal element 322 may be made of an elastomeric and/or poly material, such as rubber, dissolvable rubber, nitrile rubber, Viton or polyurethane. In an embodiment, the seal element 622 may be made from 75 to 80 Duro A elastomer material.

The seal element 322 may be configured to expand and elongate a radial manner, into sealing engagement with the surrounding tubular (208) upon compression of the tool components. Accordingly, the seal element 322 may provide a fluid-tight seal of the seal surface against the tubular.

The seal element 322 may be disposed within a circular carrier ring groove 323*a*. The seal element 322 may be molded or bonded into the groove 323*a*. The seal element 322 may not only provide a sealing function for the tool 302 (against a tubular) and/or against the cone mandrel 314, but may also act as a pseudo-piston surface. Meaning, as pressure from above the tool increases, the pressure may further act on the seal element 322 and urge the carrier ring 323 further up the cone mandrel 314, and thus may boost or enhance the sealing performance of the tool 302.

The downhole tool 302 may have the slip 334 disposed around (at least an end 346 of) the cone mandrel 314. The slip 334 may be a one-piece slip, whereby the slip 334 has at least partial connectivity across its entire circumference. Meaning, while the slip 334 itself may have one or more grooves 344 configured therein, the slip 334 need not be multi-segment with an at least one separation point in the pre-set configuration.

The use of a rigid single- or one-piece slip configuration may reduce the chance of presetting that is associated with conventional slip rings, as conventional slips are known for pivoting and/or expanding during run in. As the chance for pre-set is reduced, faster run-in times are possible. Just the same, embodiments herein may utilize a multi-segmented slip.

The slip 334 may include a feature for gripping the inner wall of a tubular, casing, and/or well bore, such as a plurality of gripping elements, including serrations or teeth, inserts 375, etc. The gripping elements may be arranged or configured whereby the slip 334 may engage the tubular (not shown) in such a manner that movement (e.g., longitudinally axially) of the slips or the tool once set is prevented. In an embodiment, the inserts 375 may be epoxied or press fit into corresponding insert bores or grooves 378 formed in the slip 334.

The slip 334 may include one or more grooves 344. The grooves 344 may be longitudinal in length spanning from a first slip end 341 to another slip end 343. In an embodiment, the grooves 344 may be equidistantly spaced or cut in the slip 334. In other embodiments, the grooves 344 may have an alternatingly arranged configuration (not shown here). That is, one groove may be more proximate to slip end 341 and an adjacent groove may be more proximate to the opposite slip end 343. One or more grooves 344 may extend all the way through the slip end 341 (not shown here), such that slip end 341 (alternatively, end 343) may be devoid of material at point. The slip 334 may have an outer slip surface 388 and an inner slip surface 389.

The arrangement or position of the grooves 344 of the slip 334 may be designed as desired. In an embodiment, the slip 334 may be designed with grooves 344 resulting in equal distribution of radial load along the slip 334. One or more grooves 344 may extend proximate or substantially close to the slip end(s) 341, 343 but leaving a small amount material 342 therein. The presence of the small amount of material between segment ends may give slight rigidity to hold off the tendency to flare. There may be one or more grooves 344 that form a lateral opening through the entirety of the slip body. That is, any groove 344 may extend a depth D from the outer slip surface 388 to the inner slip surface 389. The depth D may define a lateral distance or length of how far material is removed from the slip body with reference to the slip surface 388 (or also slip surface 389). The depth D need not go through all the way through the slip (body) 334.

Although not shown here, to aid fracture of the slip 334, there may be a first or primary fracture point, which may be a groove, chip, or some other form of removal of slip material. The first fracture point may be configured to induce fracture of the slip 334 at this point before fracture occurs at any other point in the slip 334. There may be about two to about four primary fracture points. There may be a second or secondary fracture point, which may be determined or configured by an amount of material present. A first groove 344 may be associated with the first induced fracture point, and a second (or adjacent) groove may be associated with the second induced fracture point.

The first fracture point may be configured to fracture upon the tool 302 being subjected to a setting load of about 1,000 lbf to about 4,000 lbf. The secondary fracture point may be configured to fracture upon the tool 302 being subjected to the setting load being in the range of about 5,000 lbf to about 10,000 lbf.

The slip 334 may be used to lock the tool 302 in place during the setting process by holding potential energy of compressed components in place. The slip 334 may also prevent the tool from moving as a result of fluid pressure against the tool. The slip 334 may have an alternating groove/window configuration around its body. For example, there may be a groove 344, then a window 345, follow by subsequent adjacent grooves 344 and windows 345, respectively. In longitudinal length, the window 345 may be about less than or equal to the groove 344.

The slip 334 may be coupled or engaged with a lower sleeve 360. Coupling may be via one or more pins 359 disposed within pin window 345 (of the slip 334) and corresponding pin grooves 366 of the lower sleeve 360. While not limited to any particular shape, the pin windows 345 may be elongated oval, cylindrical, or elliptical in nature. The oversize of the pin window 345 may provide for a degree of movement of the respective pin 359.

FIGS. 2C and 2D illustrate the degree of movement for the pin (259) with respect to the window (245) between unset/run-in and set position of the tool (202/302). The pin 359 may need a lateral length suitable to hold the sleeve 360 with the tool 302 during assembly/run-in, and also the set position. While press-fit of the pin 359 into the pin groove 366 may suffice, to ensure the pin 359 may be maintained in place, the pin 359 may be bonded or adhered to the lower sleeve 360. In embodiments, the pin 359 may be threaded to the lower sleeve 360.

Referring now to FIGS. 4A and 4B together, a longitudinal side cross-sectional view of a downhole tool having a flapper, and a longitudinal side cross-sectional view of the downhole tool of FIG. 4A with the flapper open, respectively, in accordance with embodiments disclosed herein, are shown.

Downhole tool 402 may be run, set, and operated as described herein and in other embodiments (such as in System 200, and so forth), and as otherwise understood to one of skill in the art. Components of the downhole tool 402 may be arranged and disposed about a cone mandrel 414, as described herein and in other embodiments, and as otherwise understood to one of skill in the art. Thus, downhole tool 402 may be comparable or identical in aspects, function, operation, components, etc. as that of other tool embodiments disclosed herein. Similarities may not be discussed for the sake of brevity. For example, setting tool assembly 317 may be useable with the tool 402, as would be apparent to one of skill in the art.

The downhole tool 402 may have a flapper (or flapper valve) 470. The flapper 470 may be configured to move between an open position 473 and a closed position 472. The flapper 470 may be movingly (such as pivotably) coupled with the cone mandrel 414. The tool 402 may include a bias member/pin 471 for coupling the flapper 470 with the cone mandrel 414. The bias member 471 may be configured to bias the flapper 470 in the closed position 472.

During assembly or run in, the flapper 470 may be held in the open position 473 as a result of part of the setting tool assembly being positioned therein (e.g., such as [part of] a tension mandrel). The flapper 470 may be configured to rest against a seat 486 formed in the cone mandrel 414.

One of skill would appreciate that in the closed position 472, fluid flow may be blocked from one direction, while fluid flow from another direction may open the flapper 470. Other configurations of the flapper 470 may be possible, and the tool 402 is not limited to the embodiments of FIGS. 4A and 4B.

Advantages

Embodiments of the downhole tool are smaller in size, which allows the tool to be used in slimmer bore diameters. Smaller in size also means there is a lower material cost per tool. Because isolation tools, such as plugs, are used in vast numbers, and are generally not reusable, a small cost savings per tool results in enormous annual capital cost savings.

When downhole operations run about $30,000-$40,000 per hour, a savings measured in minutes (albeit repeated in scale) is of significance.

A synergistic effect is realized because a smaller tool means faster drilling time is easily achieved. Again, even a small savings in drill-through time per single tool results in an enormous savings on an annual basis.

As the tool may be smaller (shorter), the tool may navigate shorter radius bends in well tubulars without hanging up and presetting. Passage through shorter tool has lower hydraulic resistance and can therefore accommodate higher fluid flow rates at lower pressure drop. The tool may accommodate a larger pressure spike (ball spike) when the ball seats.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole setting system for use in a wellbore, the system comprising:

a workstring;

a setting tool assembly coupled to the workstring, the setting tool assembly further comprising:

a tension mandrel comprising a first tension mandrel end and a second tension mandrel end; and a setting sleeve;

a downhole tool comprising:

a cone mandrel comprising:

a distal end; a proximate end; an outer surface; an inner flowbore extending therethrough from the proximate end to the distal end; and a ball seat in the inner flowbore, a carrier ring slidingly engaged with the outer surface at the proximate end, the carrier ring further comprising an outer seal element groove;

a seal element disposed in the outer seal element groove;

a slip engaged with the outer surface at the distal end; and a lower sleeve coupled with the slip, wherein the downhole tool has an unset position comprising the tension mandrel disposed through the downhole tool, wherein in the unset position a nose nut is engaged with each of the second tension mandrel end and the downhole tool, wherein the downhole tool has a set position comprising the tension mandrel disconnected therefrom and removed from the inner flowbore, wherein the outer surface comprises a first angled surface and a second angled surface, wherein the first angled surface comprises a first plane that in cross section bisects a longitudinal axis at a first angle, wherein the second angled surface comprises a second plane that in cross section bisects the longitudinal axis at a second angle negative to that of the first angle, wherein the first angled surface and the second angled surface converge at a crest, wherein with respect to a lateral the crest has a crest wall thickness greater than each of a furthermost distal end wall thickness and a furthermost proximate end wall thickness, and wherein in each of the set position and the unset position, the ball seat is relatively disposed between the location of the carrier ring and the slip.

2. The downhole setting system of claim 1, wherein the ball seat is defined by a first portion of the inner flowbore having a first inner diameter smaller than another portion of the inner flowbore having a second inner diameter, and wherein the first inner diameter of the first portion between the ball seat and the distal end is constant.

3. The downhole setting system of claim 2, wherein the first angle is in a first angle range of 5 degrees to 10 degrees.

4. The downhole setting system of claim 1, wherein the slip comprises an at least one slip groove that forms a lateral opening in the slip that is defined by a first portion of slip material at a first slip end, a second portion of slip material at a second slip end, and a depth that extends from a slip outer surface to a slip inner surface.

5. The downhole setting system of claim 4, wherein when the downhole tool is in the set position or the unset position, the carrier ring comprises an underside surface entirely in contact with the outer surface.

6. The downhole setting system of claim 5, wherein any component of the downhole tool is made of a dissolvable metal-based material.

7. The downhole setting system of claim 1, wherein the carrier ring comprises an underside surface entirely in contact with the outer surface.

8. The downhole setting system of claim 7, wherein the lower sleeve comprises a shear tab, and wherein a longitudinal length of the downhole tool after being moved to the set position is in a set length range of at least 5 inches to no more than 15 inches.

9. The downhole setting system of claim 8, wherein the ball seat is defined by a first portion of the inner flowbore having a first inner diameter smaller than another portion of the inner flowbore having a second inner diameter.

10. The downhole setting system of claim 7, wherein the first angle has a first angle range of 5 degrees to 10 degrees.

11. A downhole setting system for use in a wellbore, the system comprising:

a workstring;

a setting tool assembly coupled to the workstring, the setting tool assembly further comprising:

a tension mandrel comprising a first tension mandrel end and a second tension mandrel end; and a setting sleeve;

a downhole tool comprising:

a cone mandrel comprising:

a distal end; a proximate end; an outer surface; an inner flowbore extending through the cone mandrel from the proximate end to the distal end; and a ball seat in the inner flowbore, a carrier ring slidingly engaged with the proximate end, the carrier ring further comprising an outer seal element groove;

a seal element disposed in the outer seal element groove;

a slip engaged with the distal end; and a lower sleeve coupled with the slip, wherein the downhole tool has an unset position comprising the tension mandrel disposed through the downhole tool, wherein in the unset position a nose nut is engaged with each of the second tension mandrel end and the downhole tool, wherein the outer surface comprises a first angled surface and a second angled surface, wherein the first angled surface comprises a first plane that in cross section bisects a longitudinal axis at a first angle having a first angle range of 5 degrees to 10 degrees, wherein the second angled surface comprises a second plane that in cross section bisects the longitudinal axis at a second angle that is negative to that of the first angle, wherein the downhole tool has a set position comprising the tension mandrel disconnected therefrom and removed from the inner flowbore, wherein the first angled surface and the second angled surface converge at a crest, wherein with respect to a lateral the crest has a crest wall thickness greater than each of a furthermost distal end wall thickness and a furthermost proximate end wall thickness, and wherein in each of the set position and the unset position, the ball seat is relatively disposed between the location of the carrier ring and the slip.

12. The downhole setting system of claim 11, wherein the slip comprises an at least one slip groove that forms a lateral opening in the slip that is defined by a first portion of slip material at a first slip end, and a depth that extends from a slip outer surface to a slip inner surface.

13. The downhole setting system of claim 11, wherein any component of the downhole tool is made of a dissolvable metal-based material.

14. The downhole setting system of claim 13, wherein the carrier ring comprises an underside surface entirely in contact with the outer surface.

15. The downhole setting system of claim 13, wherein the downhole tool comprises a shear tab, and wherein a longitudinal length of the downhole tool in the set position is in a set length range of at least 5 inches to no more than 15 inches.

16. The downhole setting system of claim 13, wherein the outer surface of the cone mandrel is void of threads.

17. The downhole setting system of claim 16, wherein the ball seat is defined by a first portion of the inner flowbore having a first inner diameter smaller than another portion of the inner flowbore having a second inner diameter, and wherein the first inner diameter of the first portion between the ball seat and the distal end is constant.

18. A downhole setting system for use in a wellbore, the system comprising:

a workstring;

a setting tool assembly coupled to the workstring, the setting tool assembly further comprising:

a tension mandrel comprising a first tension mandrel end and a second tension mandrel end; and a setting sleeve;

a downhole tool comprising:

a cone mandrel comprising:

a distal end; a proximate end; an outer surface; an inner flowbore; and a ball seat formed on an inner surface of the inner flowbore, a carrier ring slidingly engaged with the proximate end, the carrier ring further comprising an outer seal element groove;

a seal element disposed in the outer seal element groove;

a slip engaged with the distal end; and a lower sleeve coupled with the slip, wherein the downhole tool has an unset position comprising the tension mandrel disposed through the downhole tool, wherein in the unset position a nose nut is engaged with each of the second tension mandrel end and the downhole tool, wherein the downhole tool has a set position comprising the tension mandrel disconnected and removed from the inner flowbore;

wherein the outer surface comprises a first angled surface and a second angled surface, wherein the first angled surface comprises a first plane that in cross section bisects a longitudinal axis at a first angle having a first angle range of 5 degrees to 10 degrees, wherein the second angled surface comprises a second plane that in cross section bisects the longitudinal axis at a second angle that is negative to that of the first angle, wherein the slip comprises an at least one slip groove that forms a lateral opening in the slip that is defined by a depth that extends from a slip outer surface to a slip inner surface, wherein any component of the downhole tool is made of a dissolvable metal-based material, wherein the carrier ring comprises an underside surface in contact with the outer surface whether the downhole tool is in the set position or the unset position, wherein the first angled surface and the second angled surface converge at a crest, and wherein with respect to a lateral the crest has a crest wall thickness greater than each of a furthermost distal end wall thickness and a furthermost proximate end wall thickness, wherein the ball seat is defined by a first portion of the inner flowbore having a first inner diameter smaller than another portion of the inner flowbore having a second inner diameter, wherein in each of the set position and the unset position, the ball seat is relatively disposed between the location of the carrier ring and the slip, and wherein the first inner diameter of the first portion between the ball seat and the distal end is constant.

19. The downhole setting system of claim 18, wherein the downhole tool comprises a shear tab, and wherein a longitudinal length of the downhole tool in the set position is in a set length range of at least 5 inches to no more than 15 inches.

20. The downhole setting system of claim 19, wherein the outer surface of the cone mandrel is void of threads and wherein the set position comprises the downhole tool engaged with a surrounding surface.

* * * * *